US011012790B2

(12) United States Patent
Parker et al.

(10) Patent No.: US 11,012,790 B2
(45) Date of Patent: May 18, 2021

(54) FLIPCHIP PACKAGE

(71) Applicant: INVENSENSE, INC., San Jose, CA (US)

(72) Inventors: Jeremy Parker, Chelmsford, MA (US); Kazunori Hayata, Cupertino, CA (US)

(73) Assignee: INVENSENSE, INC., San Jose, CA (US)

( * ) Notice: Subject to any disclaimer, the term of this patent is extended or adjusted under 35 U.S.C. 154(b) by 0 days.

(21) Appl. No.: 16/543,076

(22) Filed: Aug. 16, 2019

(65) Prior Publication Data

US 2020/0059737 A1 Feb. 20, 2020

Related U.S. Application Data

(60) Provisional application No. 62/765,079, filed on Aug. 17, 2018.

(51) Int. Cl.

| | |
|---|---|
| ***H04R 19/04*** | (2006.01) |
| ***H04R 7/16*** | (2006.01) |
| ***H04R 31/00*** | (2006.01) |

(52) U.S. Cl.

CPC ..... *H04R 19/04* (2013.01); *H04R 7/16* (2013.01); *H04R 31/003* (2013.01); *H04R 2201/003* (2013.01)

(58) Field of Classification Search

CPC ..... H04R 1/023; H04R 1/08; H04R 1/083; H04R 1/086; H04R 1/222; H04R 19/005; H04R 19/04; H04R 2499/11; H04R 1/04; H04R 1/028; H04R 1/2876; H04R 2420/07; B81B 7/0061; B81B 2201/0257; B81B 2207/012

USPC ..... 381/170–176

See application file for complete search history.

(56) References Cited

U.S. PATENT DOCUMENTS

2005/0207605 A1* 9/2005 Dehe ..... H04R 19/04 381/369
2013/0032936 A1* 2/2013 Formosa ..... B81C 1/00309 257/704
2014/0367808 A1* 12/2014 Kuratani ..... H01L 24/09 257/416
2015/0076628 A1* 3/2015 Bolognia ..... H04R 25/405 257/416
2015/0273524 A1* 10/2015 Ely ..... G10K 9/22 310/322
2016/0037256 A1* 2/2016 Katsuda ..... H04R 1/02 381/355
2016/0165358 A1* 6/2016 Ho ..... B81B 7/0061 257/416

(Continued)

*Primary Examiner* — Fan S Tsang
*Assistant Examiner* — Julie X Dang
(74) *Attorney, Agent, or Firm* — Amin, Turocy & Watson, LLP

(57) ABSTRACT

A system and method for the manufacture of flipchip microelectromechanical system devices. A method comprises forming a cavity from a first surface of a rigid back through to a second surface of the rigid back, depositing an anisotropic conductive film over the first surface of the multilayer rigid back to conform to a contour of a microelectromechanical system device, positioning the a microelectromechanical system device over the cavity formed in the multilayered rigid back, and causing contact of the microelectromechanical system device with the anisotropic conductive film deposited over the first surface of the multilayer rigid back.

20 Claims, 6 Drawing Sheets

(56) References Cited

U.S. PATENT DOCUMENTS

| | | | | |
|---|---|---|---|---|
| 2017/0260043 | A1* | 9/2017 | Lin | B81B 7/007 |
| 2020/0059737 | A1* | 2/2020 | Parker | H04R 19/04 |

* cited by examiner

FLIPCHIP PACKAGE

CROSS REFERENCE TO RELATED APPLICATIONS

This application claims priority to U.S. Provisional Patent Application Ser. No. 62/765,079, titled: "FLIPCHIP PACKAGE," filed Aug. 17, 2018, the disclosure of which is hereby incorporated herein by reference in its entirety.

TECHNICAL FIELD

The subject disclosure relates generally to flipchip packaging that improves manufacturability of microelectromechanical system (MEMS) devices, such as flipchip microphone devices, utilizing anisotropic conductive adhesive materials.

BACKGROUND

Currently, the manufacture of microelectromechanical system (MEMS) devices, such as flipchip devices, have employed rigid bonding (e.g., gold stud-bump) to provide mechanical and/or electrical connection between the MEMS device and a substrate (e.g., silicon substrate). Thereafter, a separate sealing material has typically been applied to achieve an acoustic seal between the MEMS device and substrate.

SUMMARY

The following presents a simplified summary of the specification to provide a basic understanding of some aspects of the specification. This summary is not an extensive overview of the specification. It is intended to neither identify key or critical elements of the specification nor delineate any scope particular to any embodiments of the specification, or any scope of the claims. Its sole purpose is to present some concepts of the specification in a simplified form as a prelude to the more detailed description that is presented later.

In accordance with various embodiments, the subject application discloses a device, comprising: a substrate comprising a top surface, a bottom surface, and a cavity formed through the top surface to the bottom surface, and a microelectromechanical system device that is positioned over the cavity, wherein the microelectromechanical system device is in contact with the top surface of the silicon substrate via an anisotropic conductive material, and wherein the microelectromechanical system device comprises a back plate that is positioned directly over the cavity. The cavity can be an acoustic pathway. The device can further include an application specific integrated circuit device that is in contact with the top surface of the silicon substrate via the anisotropic conductive material.

In some embodiments, the microelectromechanical system device can be a piezoelectric microelectromechanical microphone device, a capacitive microelectromechanical microphone device, a microelectromechanical pressure sensor device, etc. In other embodiments, the anisotropic conductive material can provide a communication matrix that facilitates passage of electrical signals between the microelectromechanical system device and bond pads formed in the top surface of the substrate. In additional embodiments the anisotropic conductive material can surround the cavity forming a seal between the microelectromechanical device and the top surface.

In additional and/or alternative embodiments, the anisotropic conductive material can be deposited to cover the cavity formed in the substrate, wherein the anisotropic conductive material can be deposited to circumscribe an edge of the cavity with one or more perforations, and wherein the one or more perforations that circumscribe the edge of the cavity can facilitate removal of a selected portion of the anisotropic conductive material from the cavity.

In other embodiments, the bottom surface of the substrate comprises a solder pad. Further a lid can be positioned over the device to form an enclosure that can be referred to a back cavity space within the device. In accordance with certain embodiments, the anisotropic conductive material can be interposed between the top surface of the substrate and the lid, so that the anisotropic conductive material forms a mechanical seal between the lid and the top surface of the substrate. In additional and alternative embodiments, the anisotropic conductive material can be interposed between the top surface of the substrate and the lid, so that the anisotropic conductive material forms a watertight seal between the lid and the top surface of the substrate. In further embodiments, the anisotropic conductive material formed over the cavity can provide a waterproof membrane over the cavity. In some embodiments and based on whether the cavity is covered with the anisotropic conductive material, a vent hole can be formed in the lid, wherein the vent hole formed in the lid equalizes a pressure within the back cavity space to the ambient environmental pressure.

In accordance with further embodiments set forth herein, a method is disclosed. The method can comprise facilitating formation of a cavity from a first surface of a multilayered rigid back through to a second surface of the multilayered rigid back; facilitating deposition of an anisotropic conductive film over the first surface of the multilayer rigid back to conform to a contour of a microelectromechanical system device; facilitating positioning of the a microelectromechanical system device over the cavity formed in the multilayered rigid back, and facilitating adhesive contact of the microelectromechanical system device with the anisotropic conductive film deposited over the first surface of the multilayer rigid back.

In accordance with some embodiments, the multilayered rigid back can comprise one or more layers of a fiberglass material interposed with at least one layer of metal tracing, wherein the layer of metal tracing facilitates electrical communication between the microelectromechanical system device and an application specific integrated circuit device positioned on the multilayered rigid back. The application specific integrated circuit device can in some embodiments be in electrical contact with the microelectromechanical system device via the anisotropic conductive film.

The following description and the annexed drawings set forth certain illustrative aspects of the specification. These aspects are indicative, however, of but a few of the various ways in which the principles of the specification may be employed. Other advantages and novel features of the specification will become apparent from the following detailed description of the specification when considered in conjunction with the drawings.

BRIEF DESCRIPTION OF THE DRAWINGS

The numerous aspects, embodiments, objects and advantages of the present disclosure will be apparent upon consideration of the following detailed description, taken in conjunction with the accompanying drawings, in which like reference characters refer to like parts throughout, and in which.

DETAILED DESCRIPTION

Figure 1:
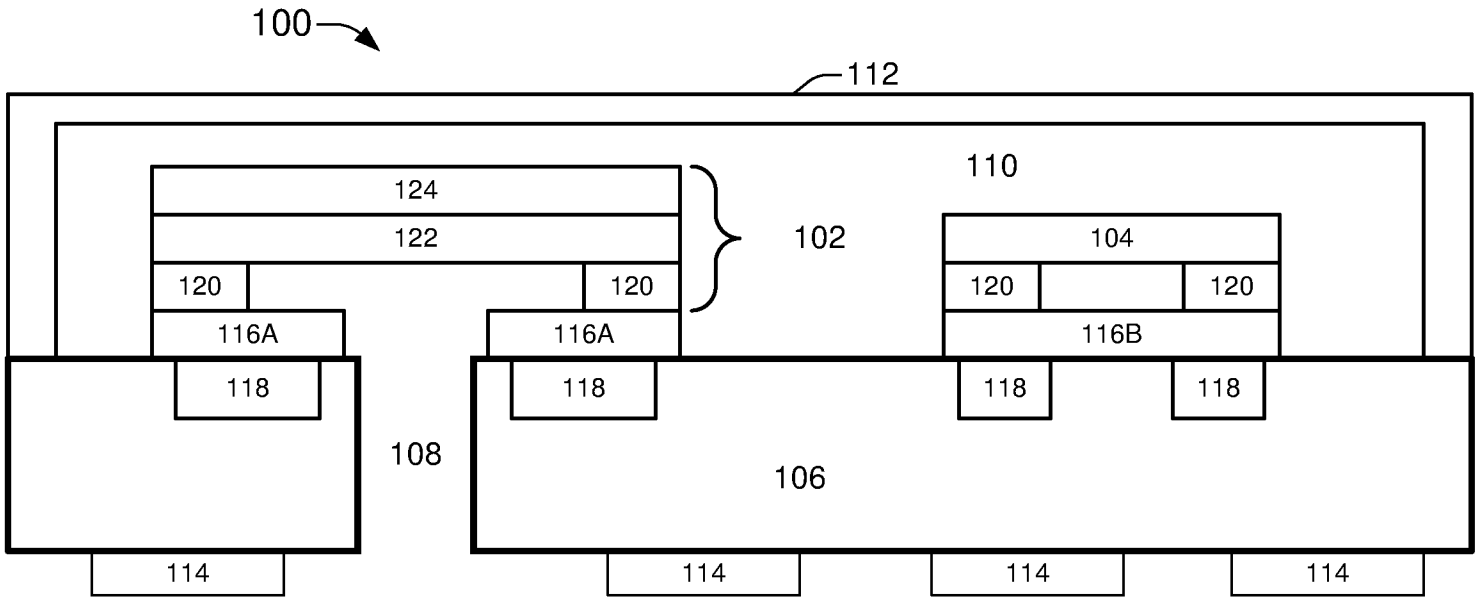
FIG. 1 provides a cross sectional illustration of a MEMS device comprising a flipchip microphone package and an application specific integrated circuit (ASIC), in accordance with various embodiments set forth in this disclosure.

One or more embodiments are now described with reference to the drawings, wherein like reference numerals are used to refer to like elements throughout. In the following description, for purposes of explanation, numerous specific details are set forth in order to provide a thorough understanding of the various embodiments. It may be evident, however, that the various embodiments can be practiced without these specific details, e.g., without applying to any particular networked environment or standard. In other instances, well-known structures and devices are shown in block diagram form in order to facilitate describing the embodiments in additional detail.

The subject application discloses and describes systems and/or methods for improving the manufacturability of microelectromechanical systems (MEMS) devices (e.g., without limitation: MEMS microphone devices, MEMS gyroscopes, MEMS accelerometers, MEMS pressure sensors, MEMS magnetometers and/or MEMS radio frequency components), thereby improving the robustness of the manufacture of MEMS devices, and in the context of MEMS microphone devices, increasing the acoustic performance of the MEMS microphone device. The improvement in manufacturability of the MEMS device can be attributed to the use of anisotropic conductive materials (e.g., anisotropic conductive films (ACF), anisotropic conductive pastes, and the like) to attach one or more MEMS devices and/or one or more application specific integrated circuit (ASIC) to a substrate (e.g., wafer that can comprise the MEMS devices). Substrates comprising one or more MEMS device can be referred to a MEMS wafers. Substrates, in this instance, can comprise a printed circuit board (PCB) and/or a ceramic laminate, for example.

In described embodiments, MEMS devices can refer to a semiconductor device implemented as a microelectromechanical system. MEMS structure can refer to any feature that may be part of a larger MEMS device. An engineered silicon-on-insulator (ESOI) can refer to a silicon-on-insulator (SOI) wafer with cavities between a silicon device layer or substrate. Handle wafer typically refers to a thicker substrate used as a carrier for a thinner silicon device substrate in a SOI wafer. Handle substrate and handle wafer can be interchanged.

In the described embodiments, a cavity can, for example, refer to an opening or recession in a substrate wafer and/or enclosure can, for instance, refer to a fully enclosed space. Post can, for example, be a vertical structure in the cavity of the MEMS device that can be employed for mechanical support. Standoff can be a vertical structure providing electrical contact.

In the described embodiments, a cavity can refer to a partially enclosed cavity used to equalize ambient pressure via Pressure Equalization Channels (PEC). In various embodiments, a back cavity can also be referred to as a back chamber. A back cavity formed within a complementary metal oxide semiconductor microelectromechanical system (CMOS-MEMS) device can be referred to as an integrated back cavity. PEC can also be referred to as leakage channels/paths and can be acoustic channels for low frequency or static pressure equalization of back cavity to ambient pressure.

In described embodiments, a rigid structure with a MEMS device that moves when subject to force can be referred to as a plate, A back plate can be a perforated plate used as an electrode.

In described embodiments, perforations refer to acoustic openings for reducing air damping in moving plates. Acoustic ports can be openings for sensing acoustic pressure. Acoustic barriers can be structures that prevent acoustic pressure from reaching certain portions of a device. Linkage can be a structure that provides compliant attachment to substrates through anchors. Extended acoustic gaps can be created by step etching of posts and creating partial post overlaps over PEC. In plane bump stops can be extensions of the plate which come into contact with the device seal to limit range of movement in the plane of the plate. Rotational bump stops are extensions of the plate to limit range rotations.

Anisotropic conductive materials (ACM) such as ACF, anisotropic conductive pastes (ACP), anisotropic conductive adhesives (ACA), . . . can be used to make electrical connections from a bond pad of a flipped MEMS devices, such as MEMS microphone device die, to a substrate. The ACM can provide an acoustic seal in these instances, as well as compliant mechanical connections between the MEMS device die and substrate. Further, ACMs generally can comprise rubber, acrylic (or acrylic based materials), and/or variations of thermo set biphenyl type epoxy resins. Typically, ACMs can have curing times that can be less than 5 seconds.

Currently, rigid bonding such as gold stud-bump bonding, has been used for mechanical and/or electrical connection between MEMS devices and substrate. A separate sealing material is currently applied to achieve the acoustic seal between the MEMS device and substrate.

Some of the advantages associated with the subject disclosure are that ACMs provide acoustic seal, electrical connection, and compliant mechanical connection all at the same time. Further, depending on the type/strength of adhesion, the ACM can allow servicing of the MEM device (e.g., in the context of the subject disclosure a flipchip microphone device). Further, by eliminating bond wire to lid clearances, the subject application reduces the package height. Further, with the front cavity of the MEMS device eliminated, additional back volume or back cavity space can be added. By eliminating or effectively enlarging the back cavity space Helmholtz resonance can be eliminated and acoustic mass loading on the diaphragm of the MEMS device reduced. Elimination of Helmholtz resonance and/or reduction of acoustic mass loading on the diaphragm can improve electro-acoustic performance of a MEMS device, such as a MEMS microphone. Additionally, the subject disclosure provides a compliant mechanical connection between the MEMS device and substrate that reduces transmitted shock into the MEMS device during robustness tests, as well as reduces MEMS device stress and performance degradation over temperature. In some disclosed embodiments one of the flipchip MEMS device and/or a lid that can enclose a back cavity can potentially be replaced and/or removed, leading to gains in manufacturability, immunity to particles and/or water, etc.

With reference now to the figures. FIG. 1 provides a cross sectional illustration of a MEMS device 100 comprising a flipchip MEMS device, such as, a flipchip microphone device 102 and an application specific integrated circuit (ASIC) 104. In accordance with various embodiments, flipchip microphone device 102 and ASIC 104 can be positioned or placed on a substrate 106. In accordance with some embodiments substrate 106 can be a laminate comprising various disparate layer. In additional and/or alternative embodiments, substrate 106 can be a multilayer engineered silicon substrate. In further additional embodiments substrate 106 can be a layered rigid back sheet. Further, in accordance with various aspects, flipchip microphone device 102 can be positioned over a cavity 108 that can have been formed through substrate 106.

As will be observed, cavity 108 can have been formed through a first surface of substrate 106 through to a second surface of substrate 106. Cavity 108 can be used as an acoustic pathway, sound port, or audio port, in instances when MEMS device 100 is configured to be operable as a MEMS microphone device, so that sound waves can enter MEMS device 100. Back cavity 110 is formed by a lid element 112 (or lid 112) that can form an enclosure (or enclosed space) associated with MEMS device 100.

As will also be observed, flipchip microphone device 102 and ASIC 104 can be positioned on a first surface of substrate 106, and one or more solder pads 114 can be located on a second surface of substrate 106.

In accordance with various embodiments, flipchip microphone device 102 can be electronically and/or mechanically situated over cavity 108 via an ACM (or ACF) die attach 116A. ACM (or ACF) die attach 116A can be formed such that one or more electrical contact point or one or more bond pad 118 positioned or formed on (or etched into) the first surface of substrate 106 can provide electrical connection to various components that can be arranged on substrate 106 (e.g., arranged on a first surface of substrate 106 and/or arranged on a second surface of substrate 106).

ACM (or ACF) die attach 116A is typically a lead-free, environmentally friendly adhesive interconnect system that can facilitate and/or effectuate electrical and/or mechanical connection between electrical/electronic components, as well as to provide electrical/electronic and/or mechanical connection between electrical/electronic components to vitreous, glassy, hyaline, glass-like, glazed surfaces, such as, for example, surfaces of silicon substrates. ACM (or ACF) die attach 116A can also be used to perform flex-to-board and/or flex-to-flex connections in MEMS devices.

It should be noted in regard to the bond pads or electrical contact points 118 positioned or formed on (or etched into) the first surface of substrate 106, that flipchip microphone device 102 can have corresponding structural and/or electrical contact points 120 that in various embodiments substantially align with bond pads or electrical contact points 118 that can be formed on the first surface of substrate 106. Nevertheless, due to the electrical conductivity features of ACM (or ACF) die attach 116A there typically is no necessity for there to be an exact positioning correspondence between bond pads or electrical contact point 118 on the first surface of substrate 106 and electrical contact points 120 that can be associated with, or formed on, flipchip microphone device 102.

In the context of ACM (or ACF) die attach 116A can be disposed around cavity 108 to conform to a circumferential boundary of flipchip microphone device 102. Thus, for example, where the circumferential boundary of flipchip microphone device 102 describes a circle, ACM (or ACF) die attach 116A can be patterned, for example, on substrate 106 to form a circle that matches the circular circumference of flipchip microphone device 102. In other embodiments, where the perimeter of flipchip microphone device 102 describes an irregular polygon, ACM (or ACF) die attach 116A can be patterned, for example, on substrate 106 to match the irregular polygonal perimeter of flipchip microphone device 102. In other instances, rather than depositing ACM (or ACF) die attach 116A on the substrate around cavity 108 to conform to the circumferential boundary of flipchip microphone device 102, ACM (or ACF) die attach 116A can be deposited over the circumferential boundary of flipchip microphone device 102 and then flipchip microphone device 102 can be situated over cavity 108, positioned to connect with bond pads or electrical contact points 118 positioned or formed on (or etched into) the first surface of substrate 106, and thereafter mated to substrate 106 to form an acoustic seal between the first surface of substrate 106 and flipchip microphone device 102, thereby acoustically sealing cavity 108 (e.g., acoustically sealing the sound port or acoustic port).

Flipchip microphone device 102, as has been noted above, can be positioned over cavity 108 that provides an acoustic port for the reception of sound waves from one or more external sources. In accordance with various disclosed embodiments, flipchip microphone device 102 can comprise a back plate 122 and diaphragm 124 that can include one or more aperture vents (not shown), wherein back plate 122 of flipchip microphone device 102 is positioned over cavity 108 and diaphragm 124 is positioned over the back plate 122. In the described embodiments, sound waves arrive through cavity 108 incident on the backplate 122 first and then on diaphragm 124 situated over back plate 122.

In other embodiments, the diaphragm is situated directly over the cavity (or sound aperture) and the back plate is formed over the diaphragm. Thus, the diaphragm receives sound waves directly through the cavity or sound port.

ASIC 104, as illustrated in FIG. 1, can also be positioned on a first side of substrate 106. As depicted, ASIC 104 can be flipped so that electrical contacts (or bond pads 120) that typically would be situated on top of ASIC 104 are placed so that these electrical contacts (or bond pads 120) come in direct contact, via ACM (or ACF) die attach 116B, with bond pads 118 located on the first side of substrate 106. In this manner, ASIC 104 can be in operative electrical and/or electronic communication with flipchip microphone device 102. Additionally, ASIC 104, via contact made through ACM (or ACF) die attach 116B to one or more electrical contact point or bond pad 118 formed on the first side of substrate 106, can also be in electronic and/or electrical communication with various other components that can be formed on the first side of substrate 106 and/or a second side of substrate 106 (e.g., via electrical and/or electronic communication through solder pads 114 formed on the second side of substrate 106).

In various embodiments, ACM (or ACF) die attach 116B can be applied over bond pads 118 formed on (e.g., etched into (or formed via one or more deposition or layering process on) substrate 106. ASIC 104 can thereafter be placed on ACM (or ACF) die attach 116B so that electrical and/or electronic contacts 120 formed on ASIC 104 come into contact with ACM (or ACF) die attach 116B, thereby providing electrical and/or electronic communication with substrate 106.

Lid 112 can in various embodiments be secured to substrate 106 in order to form an enclosure within which back cavity 110 can be enclosed. Lid 112 can be formed using one or more materials comprising metals, or ceramic and/or polymers, such as a plastic. In various embodiments, lid 112 can comprise multiple layers, one or more layers of which can be conductive and capable of transmitting electrical signals and/or providing electromagnetic shielding.

Figure 2:
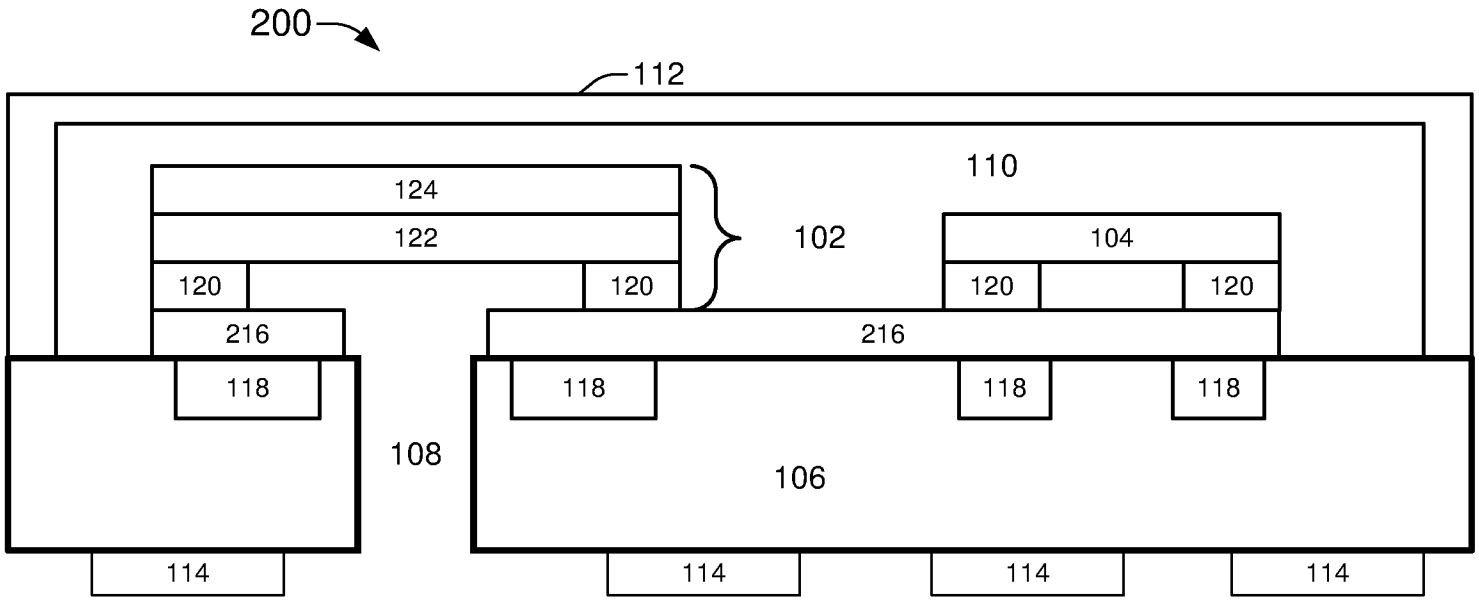
FIG. 2 provides an additional cross sectional illustration of a MEMS device comprising a flipchip microphone package and an application specific integrated circuit (ASIC), in accordance with various embodiments set forth herein.

FIG. 2 provides a cross sectional view of an additional MEMS device 200 that can comprise flipchip microphone device 102 and an application specific integrated circuit (ASIC) 104. In this illustration it will be observed that formation of ACM (or ACF) die attach 116A and ACM (or ACF) die attach 116B have been replaced by ACM (or ACF) die attach 216. ACM (or ACF) die attach 216 can be a single formation of ACM (or ACF) that can be formed under both flipchip microphone device 102 and ASIC 104. Thus, in accordance with some embodiments, ACM (or ACF) die attach 216 can be deposited to circumscribe cavity 108 (e.g., not obstruct the acoustic pathway) so that ASIC 104 and flipchip microphone device 102 contact a single continuous unit of ACM (or ACF) die attach 216. It will be noted that the single continuous unit of ACM (or ACF) die attach 216 can provide an electrical matrix through which electrical signals can be communicated, via respective bond pads (e.g., 118 and/or 120), between flipchip microphone device 102 and ASIC 104. Additionally, the single continuous unit of ACM (or ACF) die attach 216 can also facilitate signal communication, via bond pads 118 on substrate 106, to other components that can be located on a first surface of substrate 106 and/or a second surface of substrate 106.

Figure 3:
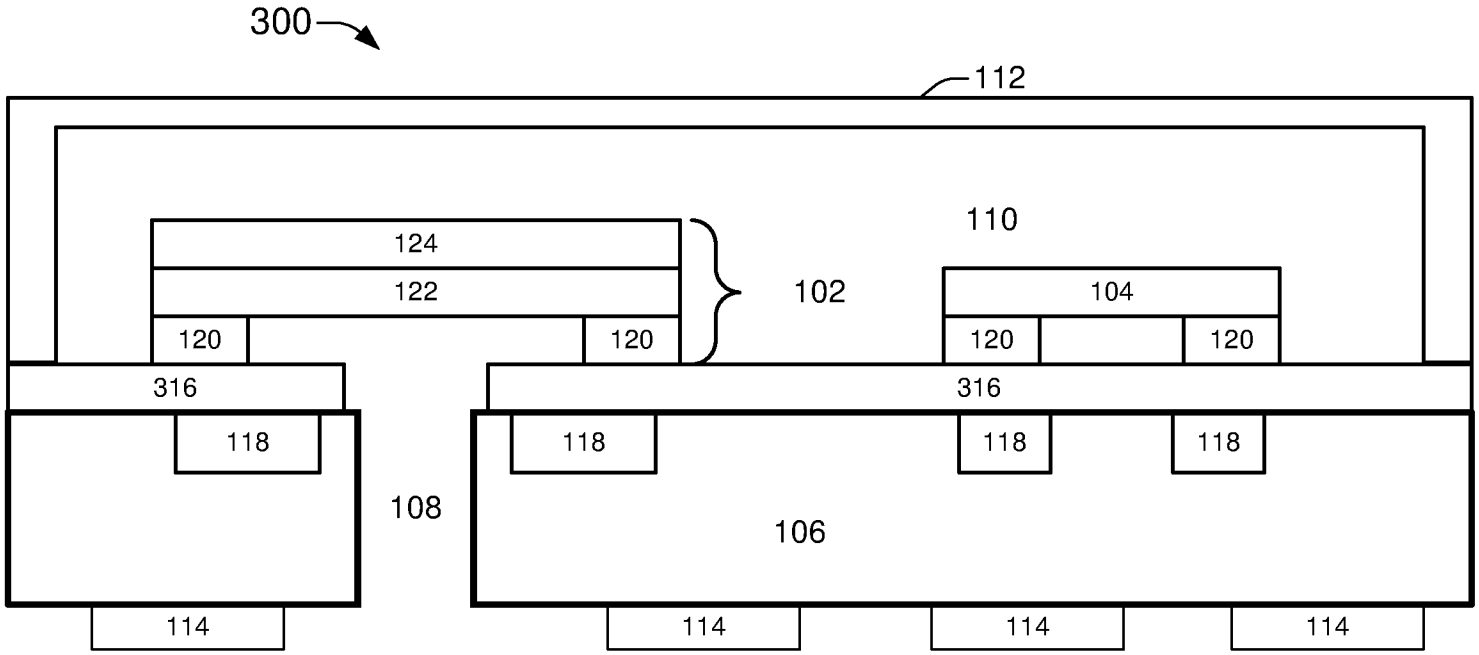
FIG. 3 provides a further cross sectional illustration of a MEMS device comprising a flipchip microphone package and an application specific integrated circuit (ASIC), in accordance with various embodiments set forth herein.

FIG. 3 provides a further cross sectional view of an additional MEMS device 300 that can comprise flipchip microphone device 102 and an application specific integrated circuit (ASIC) 104. In FIG. 3 the formation of ACM (or ACF) die attach 116A and ACM (or ACF) die attach 116B (as illustrated in FIG. 1) have been replaced by ACM (or ACF) die attach 316. ACM (or ACF) die attach 316 can be a single formation of ACM (or ACF) that can be formed under flipchip microphone device 102, ASIC 104, and lid 112. Further, ACM (or ACF) die attach 316 can be deposited to circumscribe cavity 108 (e.g., not obstruct the acoustic pathway) so that ASIC 104 and flipchip microphone device 102 contact a single continuous planar sheet of ACM (or ACF) die attach 316. Further, the single continuous planar sheet of ACM (or ACF) die attach 316 can be extended to interpose between lid 112 and a first surface of substrate 106. It will be noted, and as was observed in FIG. 2, the single continuous planar sheet of ACM (or ACF) die attach 316 can provide an electrical matrix through which electrical signals can be communicated, via respective bond pads (e.g., 118 and/or 120), between flipchip microphone device 102 and ASIC 104. Additionally, the single continuous planar sheet of ACM (or ACF) die attach 316 can also facilitate signal communication, via bond pads 118 on substrate 106, to other components that can be located on a first surface of substrate 106 and/or a second surface of substrate 106. Further, the single continuous planar sheet of ACM (or ACF) die attach 316 can also provide electrical contact between lid 112 and the first surface of substrate 106; and between lid 112 and components situated on the first surface of substrate 106 (e.g., flipchip microphone device 102 and/or ASIC 104) and components that can have been positioned on the second surface of substrate 106.

Figure 4:
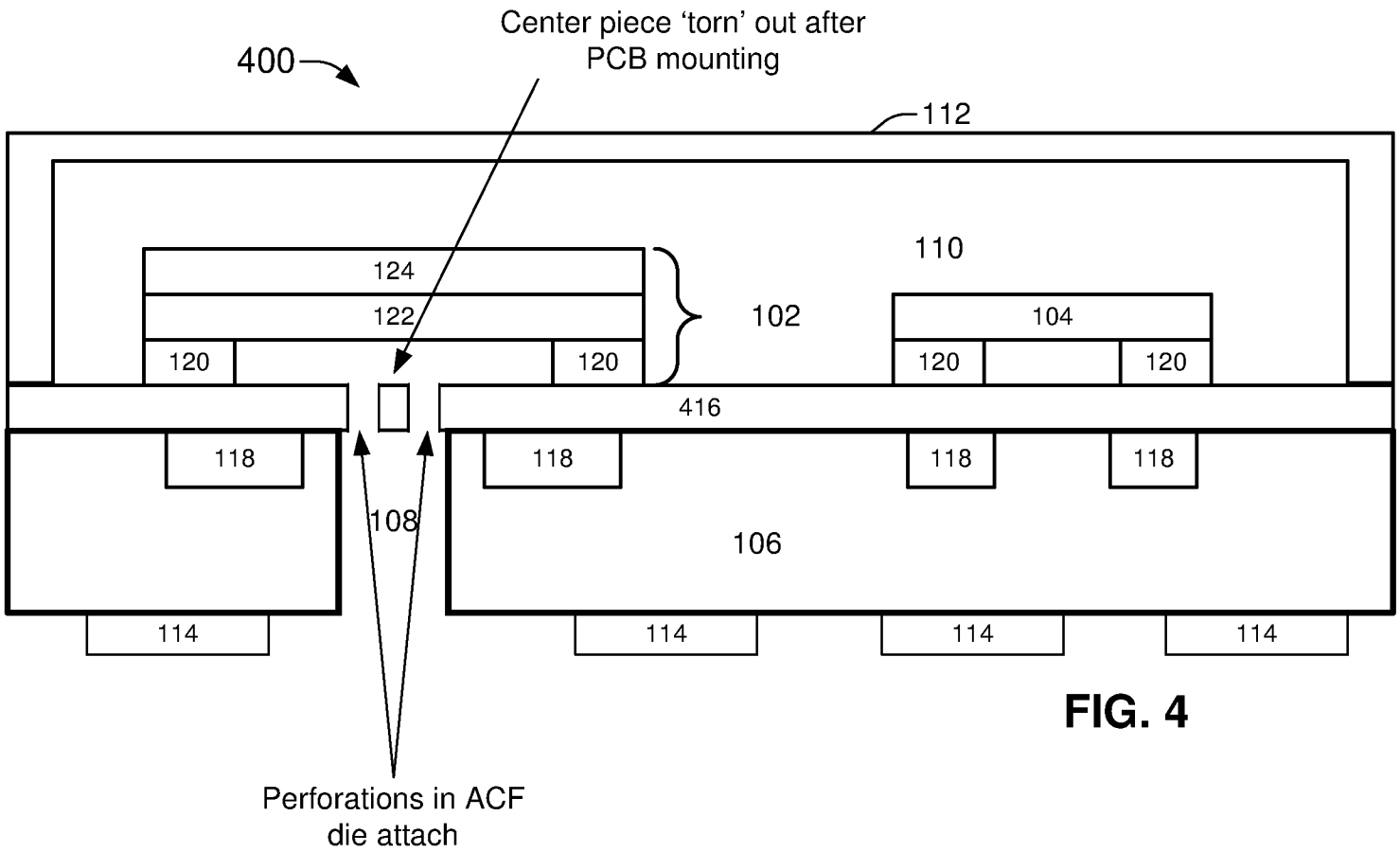
FIG. 4 provides a yet a further cross sectional illustration of a MEMS device comprising a flipchip microphone package and an application specific integrated circuit (ASIC), in accordance with various embodiments set forth herein.

FIG. 4 provides a further cross sectional view of an additional MEMS device 400 that can comprise flipchip microphone device 102 and an application specific integrated circuit (ASIC) 104. In FIG. 4 the formation of ACM (or ACF) die attach 116A and ACM (or ACF) die attach 116B (as illustrated in FIG. 1) have been replaced by ACM (or ACF) die attach 416. ACM (or ACF) die attach 416 can be a single formation of ACM (or ACF) that can be formed under flipchip microphone device 102, ASIC 104, and lid 112. Further, ACM (or ACF) die attach 416 can be deposited over cavity 108, wherein, in accordance with some embodiments, perforations in ACM (or ACF) die attach 416 can be made to facilitate or effectuate subsequent removal of this deposition of ACM (or ACF) die attach 416 formed over cavity 108 (e.g., to not obstruct the acoustic pathway). The deposition of ACM (or ACF) die attach 416 over cavity 108 can be performed to ensure that flipchip microphone device 102 is not damaged with detritus during manufacture of MEMS device 400. The perforations formed in the ACM (or ACF) die attach 416 can be used to facilitate removal of selected portions of the ACM (or ACF) die attach 416 that overlay cavity 108. The removal of portions of the ACM (or ACF) die attach 416 can be performed, for example, once MEMS device 400 has been coupled to a printed circuit board (PCB) and in accordance with customer specifications.

As has been noted above, the ASIC 104 and flipchip microphone device 102 can contact a single continuous planar sheet of ACM (or ACF) die attach 416. Further, the single continuous planar sheet of ACM (or ACF) die attach 416 can be extended to be interposed between lid 112 and a first surface of substrate 106. The single continuous planar sheet of ACM (or ACF) die attach 416 can provide an electrical matrix through which electrical signals can be communicated, via respective bond pads (e.g., 118 and/or 120), between flipchip microphone device 102 and ASIC 104. Additionally, the single continuous planar sheet of ACM (or ACF) die attach 416 can also facilitate signal communication, via bond pads 118 formed on substrate 106, to other components that can be located on the first and/or second surfaces of substrate 106.

Figure 5:
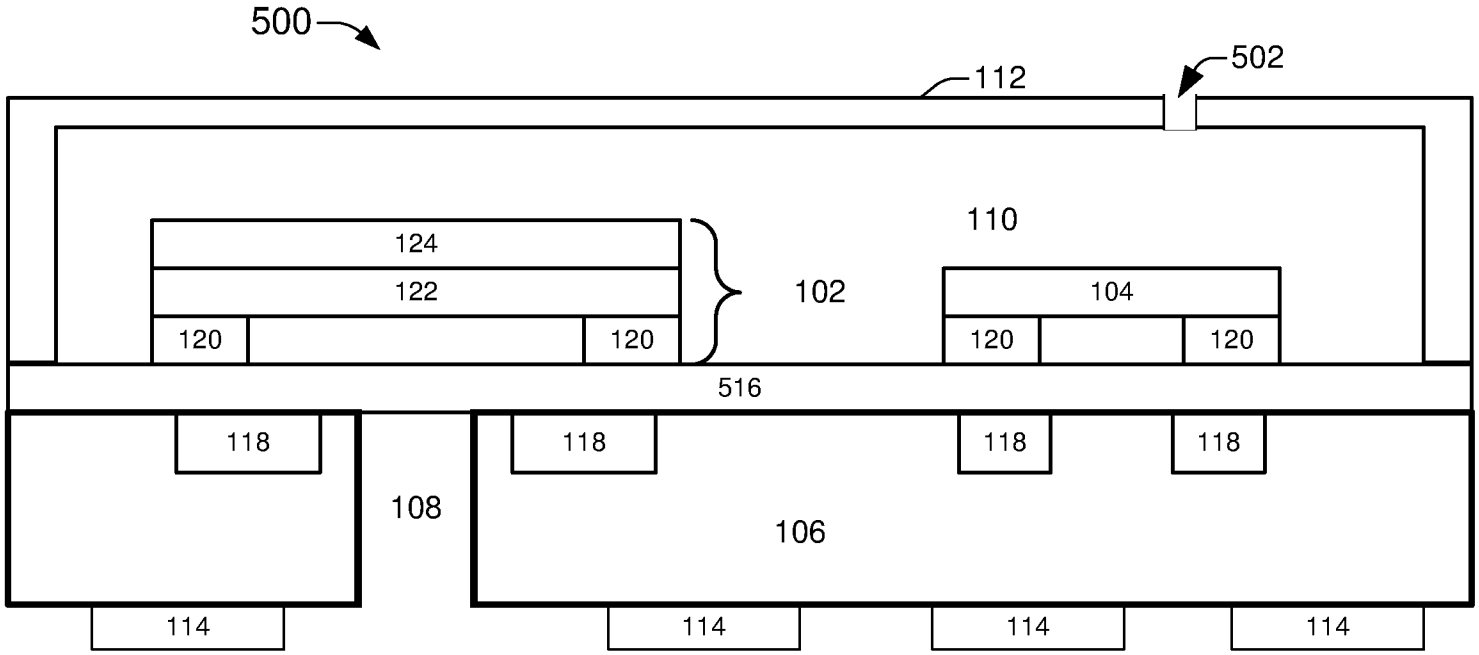
FIG. 5 provides another cross sectional illustration of a MEMS device comprising a flipchip microphone package and an application specific integrated circuit (ASIC), in accordance with various embodiments set forth herein.

FIG. 5 provides a further cross sectional view of an additional MEMS device 500 that can comprise flipchip microphone device 102 and an application specific integrated circuit (ASIC) 104. In FIG. 5 the formation of ACM (or ACF) die attach 116A and ACM (or ACF) die attach 116B (as illustrated in FIG. 1) have been replaced by ACM (or ACF) die attach 516. ACM (or ACF) die attach 516 can be a single formation of ACM (or ACF) that can be formed under flipchip microphone device 102, ASIC 104, and lid 112. In this instance, ACM (or ACF) die attach 516 can be deposited to cover cavity 108 so that ASIC 104 and flipchip microphone device 102 are in contact with a single continuous planar sheet of ACM (or ACF) die attach 516. The ACM (or ACF) die attach 516 deposited to cover cavity 108 in this instance can provide a flexible waterproof membrane over the sound port (e.g., cavity 108). Further, the flexible single continuous planar sheet of ACM (or ACF) die attach 516 can be extended to be interposed between lid 112 and a first surface of substrate 106. It will be noted, and as has been observed earlier, the single continuous planar sheet of ACM (or ACF) die attach 516 can provide a flexible electrical matrix through which electrical signals can be communicated, via respective bond pads (e.g., 118 and/or 120), between flipchip microphone device 102 and ASIC 104. Additionally, the flexible single continuous planar sheet of ACM (or ACF) die attach 516 can also facilitate signal communication, via bond pads 118 formed on substrate 106, to other components that can be located on a first surface of substrate 106 and/or a second surface of substrate 106. Further, the single continuous planar sheet of ACM (or ACF) die attach 516 can also provide electrical contact between lid 112 and the first surface of substrate 106; and between lid 112 and components situated on the first surface of substrate 106 (e.g., flipchip microphone device 102 and/or ASIC 104) and/or components that can have been positioned on the second surface of substrate 106.

It will be observed from review of FIG. 5 that since cavity 108 is overlaid with the single planar sheet of ACM (or ACF) die attach 516, there is no sound port in accordance with these embodiments, accordingly lid 112 can have formed therein a lid hole 502. Lid hole 502 can be used for pressure equalization between the back cavity 110 and the ambient environment external to MEMS device 500.

Figure 6:
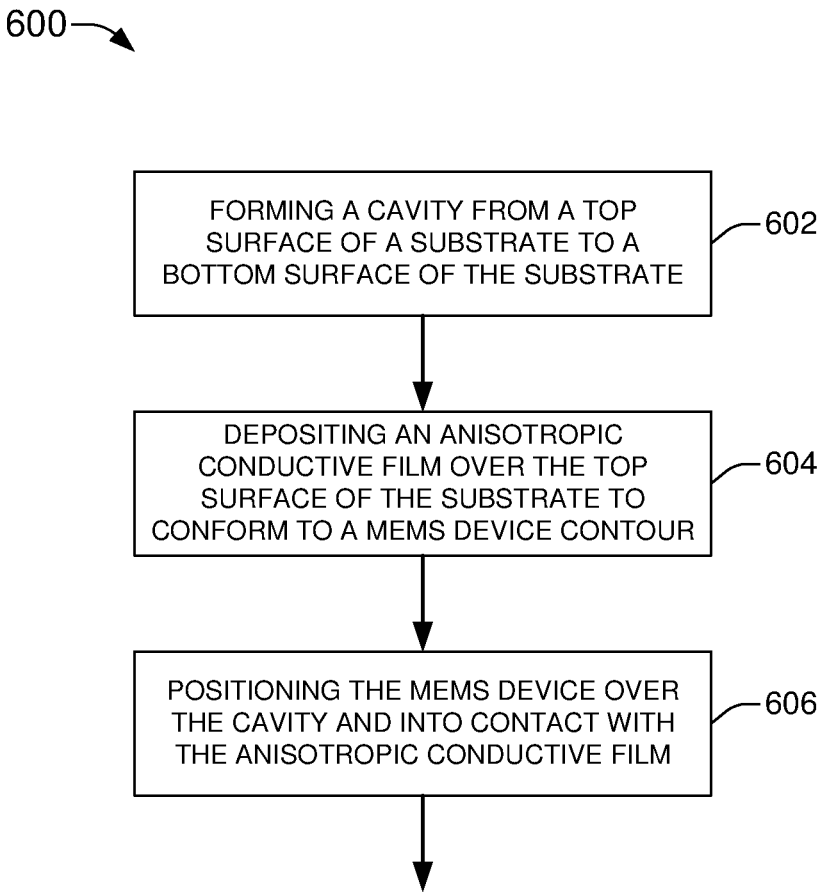
FIG. 6 illustrates a high-level example, non-limiting method the manufacture of a MEMS device comprising a flipchip microphone package and an application specific integrated circuit (ASIC), in accordance with various embodiments set forth herein.

FIG. 6 illustrates a method 600 for manufacture of a MEMS device comprising a flipchip MEMS package (such as a MEMS pressure sensor device, a piezoelectric MEMS microphone device that comprises a diaphragm but does not include a back plate, a MEMS microphone device comprising both a diaphragm and a back plate, a capacitive microphone, etc.) in accordance with one or more embodiments described herein. As illustrated method 600 can commence at act 602 wherein a cavity can be formed in a substrate. The substrate can be a laminated fiberglass based rigid back comprising vias and/or metal traces, multilayered engineered substrate, printed circuit board formed of multiple disparate layers of fiberglass and/or conductive materials, and the like. The cavity can extend from a first surface (e.g., top surface) of the substrate to a second surface (e.g., bottom surface) of the substrate. At act 604 an anisotropic conductive film (or anisotropic conductive adhesive) can be applied or deposited over the first surface of the substrate, wherein the application or deposition of the anisotropic conductive film can be laid down to conform to a contour of the flipchip MEMS package (e.g., flipchip microphone device, flipchip pressure sensor device, flip chip application specific integrated circuit, etc.). At act 606 the flipchip MEMS package can be positioned over the cavity formed in the first surface of the substrate and brought into contact with the deposited anisotropic conductive film.

As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form. In addition, the word "coupled" is used herein to mean direct or indirect electrical or mechanical coupling. In addition, the words "example" and/or "exemplary" are used herein to mean serving as an example, instance, or illustration. Any aspect or design described herein as "example" and/or "exemplary" is not necessarily to be construed as preferred or advantageous over other aspects or designs. Rather, use of the word exemplary is intended to present concepts in a concrete fashion.

What has been described above includes examples of the subject disclosure. It is, of course, not possible to describe every conceivable combination of components or methodologies for purposes of describing the subject matter, but it is to be appreciated that many further combinations and permutations of the subject disclosure are possible. Accordingly, the claimed subject matter is intended to embrace all such alterations, modifications, and variations that fall within the spirit and scope of the appended claims.

In particular and in regard to the various functions performed by the above-described components, devices, systems and the like, the terms (including reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter.

The aforementioned systems have been described with respect to interaction between several components. It can be appreciated that such systems and/or components can include those components or specified subcomponents, some of the specified components or subcomponents, and/or additional components, and according to various permutations and combinations of the foregoing. Subcomponents can also be implemented as components communicatively coupled to other components rather than included within parent components (hierarchical). Additionally, it should be noted that one or more components may be combined into a single component providing aggregate functionality or divided into several separate subcomponents, and any one or more middle layers, may be provided to communicatively couple to such subcomponents in order to provide integrated functionality. Any component described herein may also interact with one or more other components not specifically described herein.

In addition, while a particular feature of the subject disclosure may have been disclosed with respect to only one of the several implementations, such feature may be combined with one or more other features of the other implementations as may be desired and advantageous for any given or particular application. Furthermore, to the extent that the terms "includes," "including," "has," "contains," or variants thereof, and other similar words are used in either the detailed description or the claims, these terms are intended to be inclusive in a manner similar to the term "comprising" as an open transition word without precluding any additional or other elements.

What is claimed is:

1. A device, comprising:

a substrate comprising a top surface, a bottom surface, and a cavity formed through the top surface to the bottom surface; and a microelectromechanical system device that is positioned over the cavity, wherein the microelectromechanical system device is in electrical contact with the top surface of the silicon substrate via an anisotropic conductive material and a bond pad located on the top surface of the silicon substrate, wherein the microelectromechanical system device comprises a diaphragm that is positioned over the cavity, and wherein the anisotropic conductive material provides an acoustic seal between the top surface and the microelectromechanical system device.

2. The device of claim 1, wherein the cavity represents an acoustic pathway.

3. The device of claim 1, further comprising an application specific integrated circuit device that is in contact with the top surface of the silicon substrate via the anisotropic conductive material.

4. The device of claim 1, wherein the microelectromechanical system device is a microelectromechanical microphone device comprising a backplate that is positioned over the cavity.

5. The device of claim 1, wherein the anisotropic conductive material provides a communication matrix that facilitates passage of electrical signals between the microelectromechanical system device and the bond pad formed in the top surface of the substrate.

6. The device of claim 1, wherein the anisotropic conductive material surrounds the cavity forming the acoustic seal between the microelectromechanical device and the top surface.

7. The device of claim 1, wherein the anisotropic conductive material is deposited to cover the cavity formed in the substrate.

8. The device of claim 7, wherein the anisotropic conductive material deposited to cover the cavity is patterned to circumscribe an edge of the cavity with one or more perforations.

9. The device of claim 8, wherein the one or more perforations that circumscribe the edge of the cavity facilitate removal of a selected portion of the anisotropic conductive material from the cavity.

10. The device of claim 1, wherein the bottom surface of the substrate comprises a solder pad.

11. The device of claim 1, further comprising a lid that encloses a back cavity space within the device.

12. The device of claim 11, wherein the anisotropic conductive material is interposed between the top surface of the substrate and the lid.

13. The device of claim 11, wherein the anisotropic conductive material forms a mechanical seal between the lid and the top surface of the substrate.

14. The device of claim 11, wherein the anisotropic conductive material forms a watertight seal between the lid and the top surface of the substrate.

15. The device of claim 11, wherein based on the cavity being covered with the anisotropic conductive material, a vent hole is formed in the lid.

16. The device of claim 15, wherein the anisotropic conductive material formed over the cavity provides a waterproof membrane over the cavity.

17. The device of claim 15, wherein the vent hole formed in the lid equalizes a pressure within the back cavity space to an ambient environmental pressure.

18. A method, comprising:

facilitating formation, by a device comprising one or more processor, of a cavity from a first surface of a multilayered rigid back through to a second surface of the multilayered rigid back;

facilitating deposition, by the device, of an anisotropic conductive film over the first surface of the multilayer rigid back to conform to a contour of a microelectromechanical system device;

facilitating positioning, by the device, of the a microelectromechanical system device over the cavity formed in the multilayered rigid back; and facilitating contact, by the device, of the microelectromechanical system device with the anisotropic conductive film deposited over the first surface of the multilayer rigid back, wherein the anisotropic conductive film provides a conductive electrical matrix between the microelectromechanical system device and a contact point associated with the first surface of the multilayer rigid back, and wherein the anisotropic conductive film acoustically and mechanically seals the cavity from an ambient pressure.

19. The method of claim 18, wherein the multilayered rigid back comprises one or more layers of a fiberglass material interposed with at least one layer of metal tracing, wherein the at least one layer of metal tracing facilitates electrical communication between the microelectromechanical system device and an application specific integrated circuit device positioned on the multilayered rigid back.

20. The method of claim 19, wherein the application specific integrated circuit device is in electrical contact with the microelectromechanical system device via the anisotropic conductive film.

* * * * *